US011950694B1

(12) United States Patent
Boling

(10) Patent No.: US 11,950,694 B1
(45) Date of Patent: Apr. 9, 2024

(54) BRACKET FOR INSTALLING SIDE-MOUNT, SLIDE-OUT SHELVING

(71) Applicant: Chris Boling, Phoenix, AZ (US)

(72) Inventor: Chris Boling, Phoenix, AZ (US)

( * ) Notice: Subject to any disclaimer, the term of this patent is extended or adjusted under 35 U.S.C. 154(b) by 31 days.

(21) Appl. No.: 17/650,707

(22) Filed: Feb. 11, 2022

Related U.S. Application Data

(62) Division of application No. 17/116,379, filed on Dec. 9, 2020.

(60) Provisional application No. 63/079,341, filed on Sep. 16, 2020.

(51) Int. Cl.
*A47B 88/43* (2017.01)
*A47B 67/04* (2006.01)
*A47B 88/493* (2017.01)

(52) U.S. Cl.
CPC ..... *A47B 88/43* (2017.01); *A47B 67/04* (2013.01); *A47B 88/493* (2017.01)

(58) Field of Classification Search
CPC ..... A47B 88/43; A47B 88/493; A47B 67/04
See application file for complete search history.

(56) References Cited

U.S. PATENT DOCUMENTS 2,676,778 A * 4/1954 Pace ..... B60Q 1/2615 248/300
3,113,358 A * 12/1963 Zell ..... F16B 12/20 52/285.3
3,275,396 A * 9/1966 Hillson ..... A47B 88/43 312/246
3,490,797 A * 1/1970 Platte ..... F16B 5/07 403/231
3,831,338 A * 8/1974 Klingensmith ..... F16B 7/00 403/231
4,199,200 A 4/1980 Livingston
4,441,773 A 4/1984 Leiper
4,460,147 A 7/1984 Macbain
4,555,147 A * 11/1985 Jackson ..... A47B 88/43 384/19
4,659,237 A 4/1987 Rapp
5,738,020 A * 4/1998 Correia ..... E05G 1/005 109/51
6,394,567 B1 * 5/2002 Welch ..... A47B 88/43 312/334.41
7,299,667 B1 * 11/2007 Miresmaili ..... E05G 1/005 109/51
7,625,051 B1 * 12/2009 Kim ..... A47B 88/43 312/334.4
7,648,184 B2 * 1/2010 Boggess ..... G11B 33/08 296/187.05

(Continued)

OTHER PUBLICATIONS

Slide-A-Shelf, Slide-A-Shelf SAS-FE-L-M, Made-to-Fit Slide-Out Shelf, Full-Ext, 6 to 36 in. Wide, 16 1/2 to 24 in. deep, Ready-to-Finish Maple Fronts, Minimum Order is 2 Shelves, See Important INFO Below!, www.amazon.com (Oct. 13, 2020).

*Primary Examiner* — James O Hansen
(74) *Attorney, Agent, or Firm* — Venjuris, P.C.

(57) ABSTRACT

This invention is embodied in a bracket for installing side-mount, slide-out shelving. The key to this invention is an offset section of the bracket that permits the bracket to engage with a tab 4 on the side-mount slide. By engaging the bracket and the side-mount slide without having to use a fastener, an installer can locate and fasten the bracket to the existing cabinet base, thus securing the side-mount slide to the cabinet.

3 Claims, 6 Drawing Sheets

(56) References Cited

U.S. PATENT DOCUMENTS

| | | | | |
|---|---|---|---|---|
| 7,891,617 | B2 * | 2/2011 | Tisbo | A47F 5/0853 248/300 |
| 8,813,457 | B2 * | 8/2014 | Underkofler | E04B 9/30 248/221.11 |
| 9,663,948 | B2 * | 5/2017 | Lehane | E04B 9/30 |
| 2007/0182293 | A1 * | 8/2007 | Compagnucci | A47B 88/956 312/334.4 |
| 2010/0046863 | A1 * | 2/2010 | Cheng | A47B 88/43 384/19 |
| 2011/0012492 | A1 * | 1/2011 | Radusin | A47B 88/43 312/334.8 |
| 2019/0166994 | A1 | 6/2019 | Rihtarec | |

* cited by examiner

BRACKET FOR INSTALLING SIDE-MOUNT, SLIDE-OUT SHELVING

FIELD OF THE INVENTION

The present invention relates to cabinet organizers and in particular to full extension side-mount slides in the installation and use of slide-out shelving solutions for cabinets.

BACKGROUND

Slide-out shelving is a great way to organize cabinets. Many different solutions exist to create a cabinet with slide-out shelving or to retro-fit an existing cabinet with slide-out shelving. A side-mount drawer slide (or "side-mount slide") is a common way to install slide-out shelving. A common example of a side-mount slide 2 is shown in FIGS. 1 and 2.

It can be difficult to install side-mounted slides accurately, especially when retro-fitting side-mount slides to an existing cabinet. Typically, an installer must at least partially crawl into the cabinet in order to measure, align, level, and mount the hardware. Often times it can be difficult to line everything up correctly so that the slide out shelving ends up in the right place. Part of the difficulty arises when measuring, drilling and mounting hardware horizontally because the existing space is limited and the restricted viewing angles are challenging. Typical side-mount slides 2 require an installer to drive fasteners horizontally through holes 28 in tabs 4 to secure the side-mount slide to a cabinet. See, e.g, FIGS. 1 and 2.

What is needed is a side-mounting slide system that simplifies installation so that slide-out shelving can be installed into the bottom of a cabinet quicker, easier and more accurately.

SUMMARY OF INVENTION

The subject of this invention is embodied in a bracket 10 that allows a user to install a side-mount slide 2 onto the bottom of a cabinet. The key to this invention is an offset section of the bracket that permits the bracket 10 to engage with tab 4 on the side-mount slide 2. By engaging the bracket 10 with tab 4 of the side-mount slide, an installer can locate and fasten the side-mount slide to a horizontal surface instead of a vertical surface, which makes securing the side-mount slide to the existing cabinet base easier and more accurate.

The preferred bracket 10 is L-shaped, having a first leg 12 and a second leg 14. The first leg 12 has a first section 16 connected to a second section 18 and the second section 18 connected to a third section 20. The first section 16 and third section 20 are oriented in a first plane 22 and the second section 18 is oriented in a second plane 24 offset from the first plane 22.

OVERVIEW OF THE PREFERRED EMBODIMENT

Figure 1:
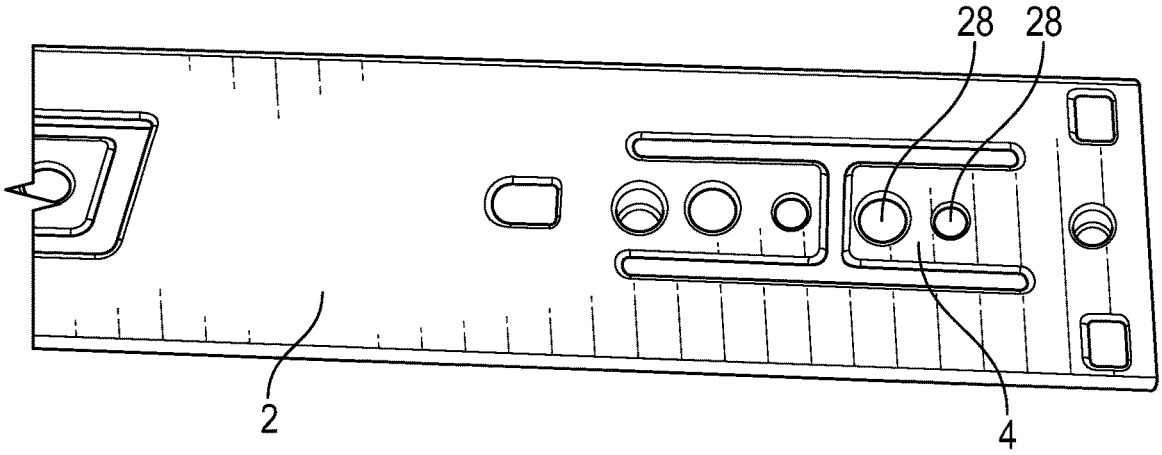
FIG. 1 (Prior Art)
FIG. 1 illustrates a prior art side-mount slide 2 with extension rails retracted.
Figure 2:
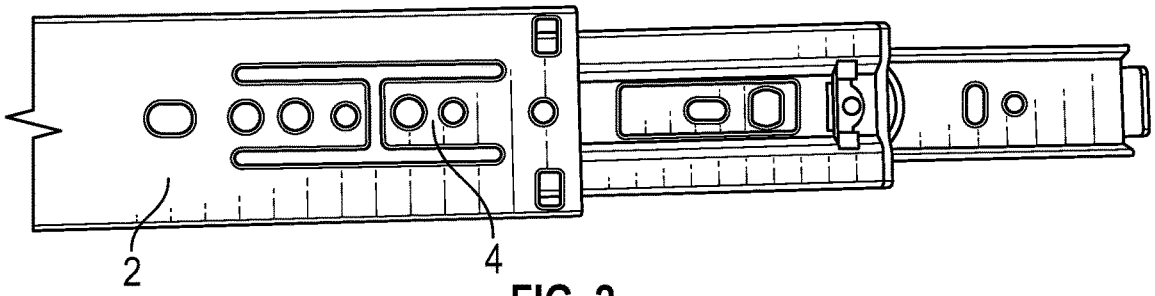
FIG. 2 (Prior Art)
FIG. 2 illustrates a prior art side-mount slide 2 with extension rails extended.
Figure 3:
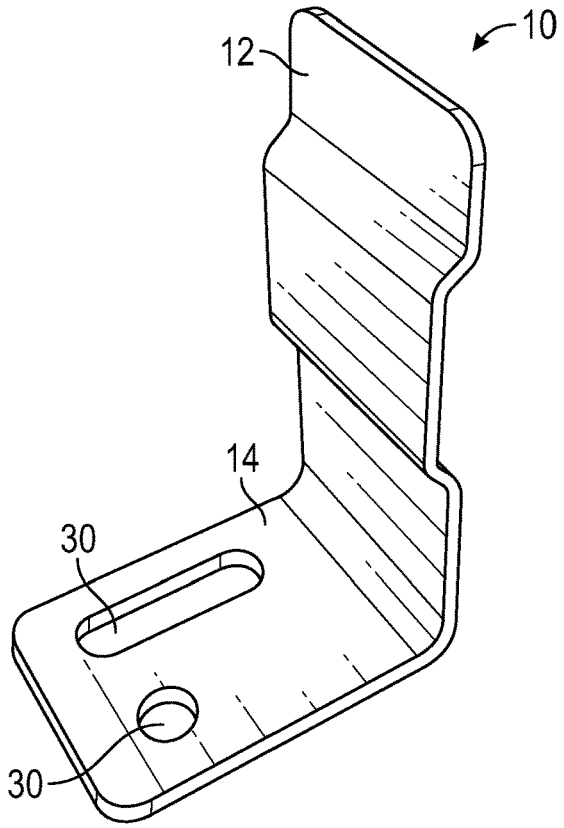
FIG. 3 illustrates a perspective view of an embodiment of the invention.
Figure 4:
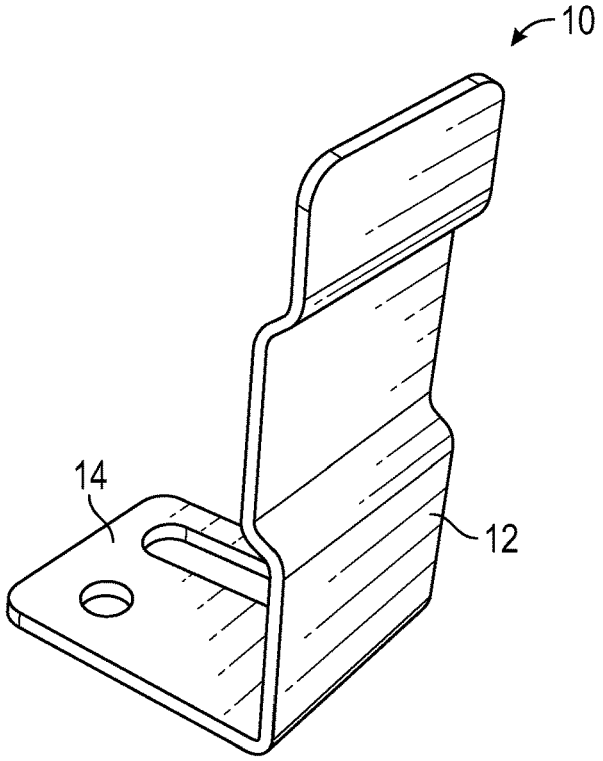
FIG. 4 illustrates a perspective view of an embodiment of the invention.
Figure 5:
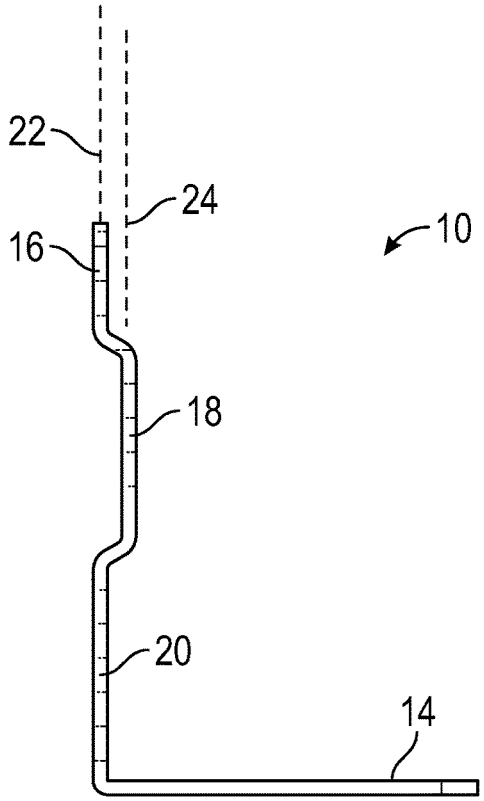
FIG. 5 illustrates a side view of an embodiment of the invention.
Figure 6:
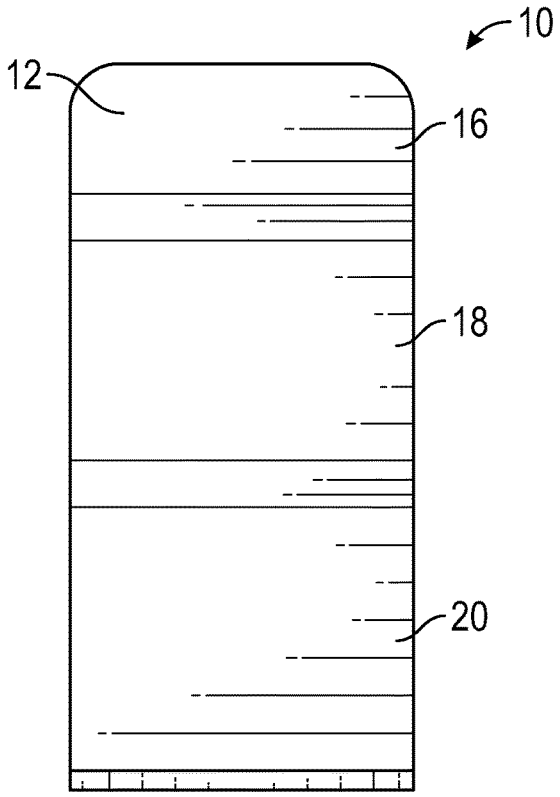
FIG. 6 illustrates a back view of an embodiment of the invention.

The preferred embodiment of the bracket is shown in FIGS. 3-6. The preferred bracket 10 is L-shaped and constructed from metal, having a first leg 12 and a second leg 14. The first leg 12 has a first section 16 connected to a second section 18. The second section 18 is connected to a third section 20. The first section 16 and third section 20 are oriented in a first plane 22 and the second section 18 oriented in a second plane 24 offset from the first plane 22. For use with typical side-mount rails, the first leg 12 would be about one and seven-eighth inches long and the second leg 14 be one and a quarter inches long.

Figure 7:
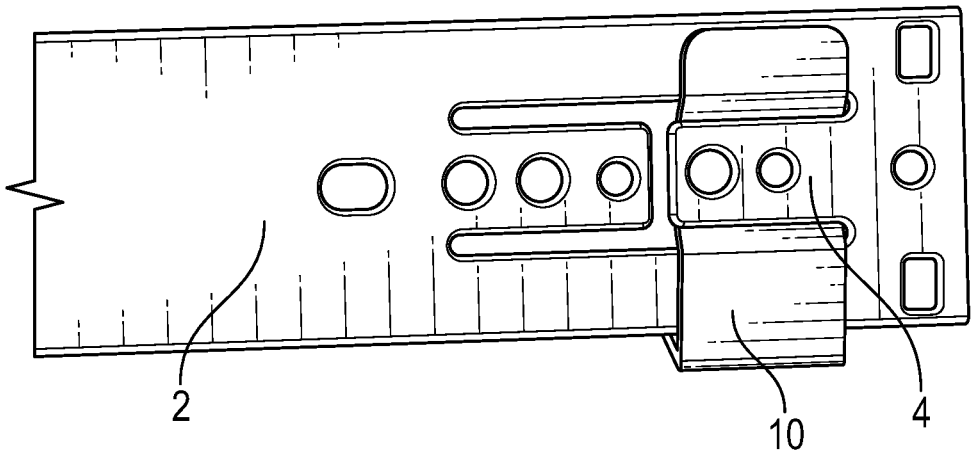
FIG. 7 illustrates a front side view of a side-mount slide 2 with bracket 10 engaging with tab 4.
Figure 8:
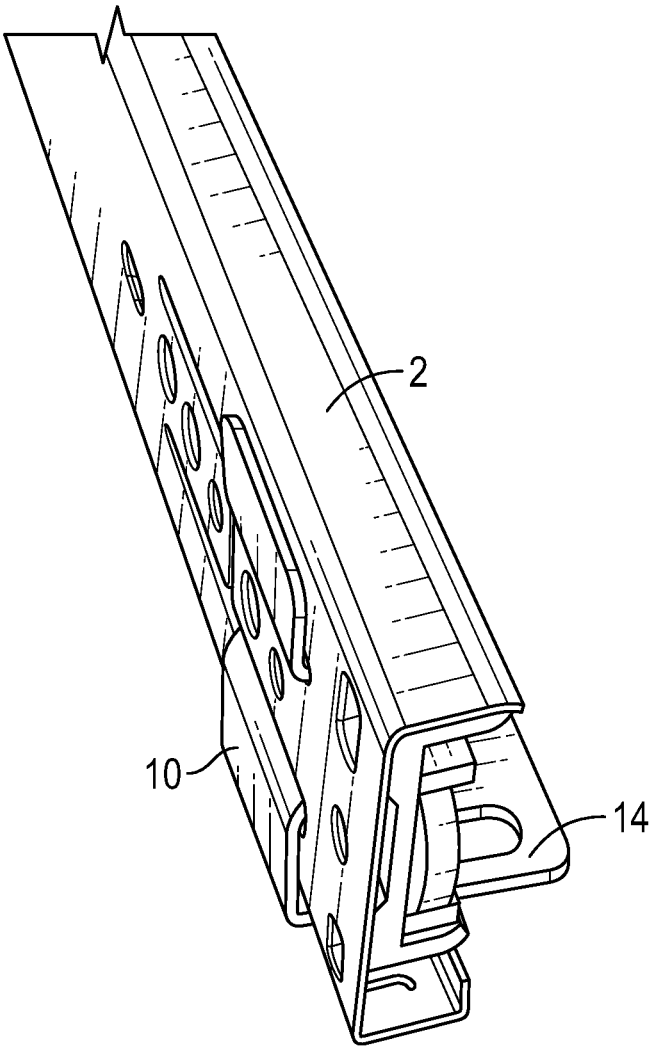
FIG. 8 illustrates a perspective end view of a side-mount slide 2 with bracket 10 engaging with tab 4.
Figure 9:
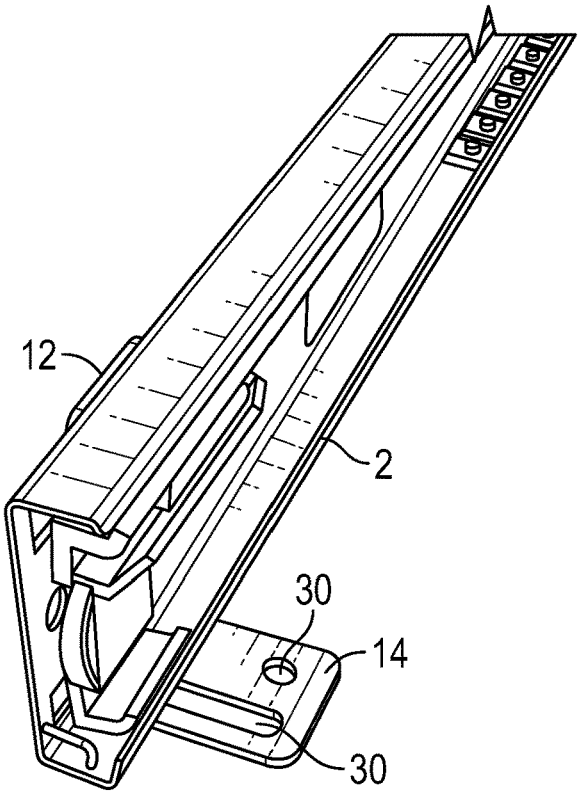
FIG. 9 illustrates a perspective back side view of a side-mount slide 2 with bracket 10 engaging with tab 4.
Figure 10:
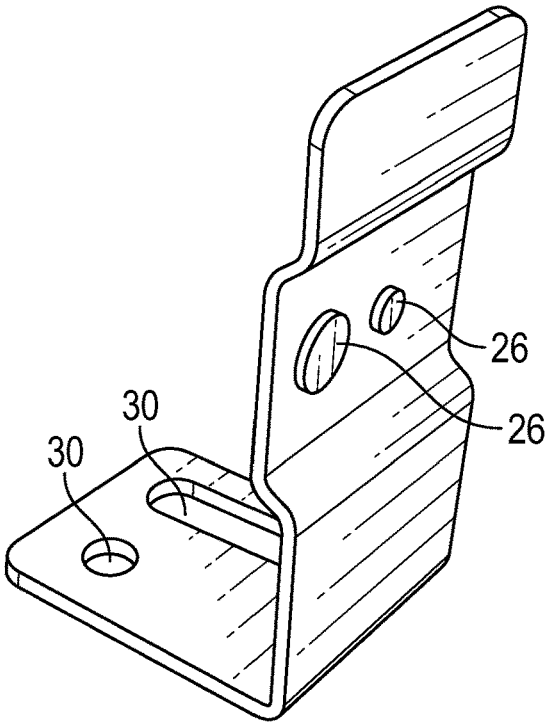
FIG. 10 illustrates a bracket 10 having nubs 26 configured to engage with holes 28 on tab 4 when the bracket 10 is engaged with the tab 4.
Figure 11:
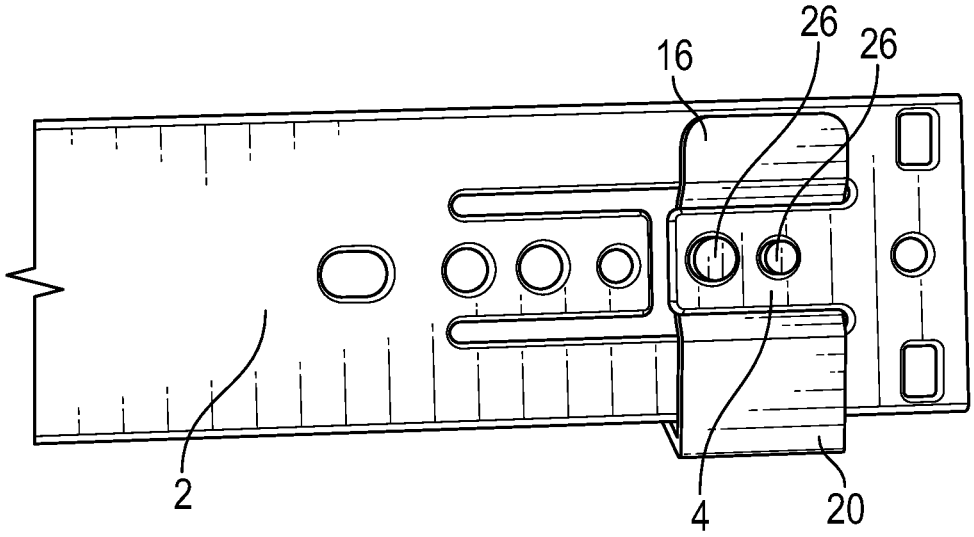
FIG. 11 illustrates a front side view of a side-mount slide 2 with bracket 10 engaging with tab 4 and nubs 26 engaging with holes 28 on tab 4.

The purpose of offsetting the second section 18 is so that the second section 18 can engage with tab 4 on a side-mounted slide 2 as shown in FIGS. 7-9. In operation, this can be accomplished by sliding the second section 18 behind tab 4 while keeping the first section 16 and the third section 20 in front of the tab 4. In this way, no fasteners are needed to connect the bracket 10 with the tab 4. For use with typical side-mount rails, the second section 18 would preferably be offset one-eighth of an inch from the first and third sections (16, 20) but an offset between one sixteenth and one quarter would be satisfactory. Of course, the most important factor is that the offset amount is at least as much as the thickness of the tab 4.

Once engaged, a user can use a fastener of choice to fasten the bracket 10 to a surface through the perforations 30 on the second leg 14. The fastened surface is preferred to be a top surface of the bottom of the interior of a cabinet or a bottom surface of the top of the cabinet. But, the user can use perforations 30 to fasten the bracket (and engaged side-mount slide) to any surface desired. By engaging bracket 10 with a side-mount slide, a user can fasten the side-mount slide perpendicularly to the face of the slide.

Optionally, the bracket 10 can have one or more raised nubs 26. The purpose of a raised nub 26 is to engage a hole 28 in the tab 4. While it has been found putting nubs 26 on the bracket 10 is not necessary to achieve satisfactory connection, adding nubs 26 can assist in further strengthening the engaged connection between the bracket 10 and the tab 4. For the purposes of this specification, a "nub" is a raised element oriented on the bracket to engage with hole 28 on tab 4. A nub can take a variety of shapes. It is preferred that the nub take a dome shape for its centering ability, but most any shape will suffice as long as it is configured to fit snugly within hole 28.

It is preferred to add perforations 30 to the second leg 14 of the bracket 10. The purpose of the perforations 30 is to accept a fastener for securing the second leg 14 to the cabinet. It is preferred to use a fastener through perforations 30 to secure the second leg to a horizontal surface. For example, the horizontal surface could be the top of the bottom surface of the interior of the cabinet (the floor) or the bottom side of the top of the interior of the cabinet (the ceiling). The perforations 30 can take many shapes, but it is preferred to have at least one perforation 30 be relatively elongated to allow for some adjustability during installation.

The transition between (a) the first section 16 and the second section 18 and (b) the second section 18 and the third section 20 preferably matches the size and shape of tab 4. In other words, the contours of the offset section of the first leg 14 should be configure to mate with the shape of tab 4.

In operation, the preferred method for installing side mounted slide-out shelving is as follows:

1. engaging a first leg of an L-shaped bracket to a tab of a side-mounted slide by sliding a second section 18 of the first leg 12 behind tab 4 while keeping the first and third sections (16, 20) of the first leg 12 in front of tab 4,
2. orienting the side-mounted slide in a cabinet, and
3. fastening the second leg 14 of the L-shaped bracket 10 to the cabinet via perforations 30.
4. Connecting a shelf to the side-mounted slide.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

The invention claimed is:

1. A method for connecting a side-mount slide to a bracket comprising the steps of:

selecting a side-mount slide comprising a tab, the tab oriented co-planar to a face of the side-mount slide, electing an L-shaped bracket comprising a first leg and a second leg, the first leg comprising a first section connected to a second section and the second section connected to a third section, the first section and the third section are not adjacent to each other because the second section is positioned between the first section and the third section, the first and third sections oriented in a first plane and the second section oriented in a second plane offset from the first plane, connecting the side-mount slide to the L-shaped bracket by sliding the second section behind the tab, engaging the second section with the tab, while keeping the first and third sections in front of the face.

2. A method for connecting a side-mount slide to a bracket comprising the steps of:

selecting a side-mount slide for shelving comprising a tab, selecting a bracket comprising a horizontal leg and a vertical leg, the vertical leg comprising a first section, a second section and a third section, the first section comprising a bottom side and a top side, the bottom side connected to the horizontal leg, the first section positioned in a first plane, the second section connected to the top side of the first section and positioned in a second plane, the second plane offset from the first plane, the second section free from perforations and, the third section connected to the second section and positioned in the first plane, and connecting the side-mount slide to the bracket by sliding the second section behind the tab while keeping the first and third sections in front of the side-mount slide.

3. A method for connecting a side-mount slide to a bracket comprising the steps of:

selecting a side-mount slide for shelving comprising a tab, the tab oriented co-planar to a face of the side-mount slide, selecting a bracket comprising a horizontal leg and a vertical leg, the vertical leg comprising a first section, a second section and a third section, the first section comprising a bottom side and a top side, the bottom side connected to the horizontal leg, the first section positioned in a first plane, the second section connected to the top side of the first section and positioned in a second plane, the second plane offset from the first plane, and the third section connected to the second section and positioned in the first plane, and connecting the side-mount slide to the bracket by sliding the second section behind the tab while keeping the first and third sections in front of the face.

* * * * *